US012071212B2

(12) United States Patent
Hagi

(10) Patent No.: US 12,071,212 B2
(45) Date of Patent: Aug. 27, 2024

(54) SUSPENSION STRUCTURE FOR OUTBOARD MOTOR AND OUTBOARD MOTOR

(71) Applicant: YAMAHA HATSUDOKI KABUSHIKI KAISHA, Iwata (JP)

(72) Inventor: Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/956,891

(22) Filed: Sep. 30, 2022

(65) Prior Publication Data

US 2023/0144964 A1 May 11, 2023

(30) Foreign Application Priority Data

Nov. 11, 2021 (JP) ..... 2021-184080

(51) Int. Cl.
*B63H 20/06* (2006.01)

(52) U.S. Cl.
CPC ..... *B63H 20/06* (2013.01)

(58) Field of Classification Search
None
See application file for complete search history.

(56) References Cited

U.S. PATENT DOCUMENTS 4,354,848 A 10/1982 Hall et al.
6,309,265 B1 10/2001 Oguma
6,645,019 B1 11/2003 Shiomi et al.
10,850,819 B2 * 12/2020 Wiatrowski ..... B63H 20/06
2010/0032545 A1 * 2/2010 Bernloehr ..... B63H 20/08 248/640
2019/0185124 A1 6/2019 Tokuda
2019/0344873 A1 * 11/2019 Kimpara ..... B63H 20/32
2020/0398963 A1 * 12/2020 Miyashita ..... B63H 20/106
2022/0194536 A1 6/2022 Mizutani et al.
2022/0194540 A1 6/2022 Mizutani et al.
2023/0102741 A1 * 3/2023 Fergus ..... B63H 20/06 440/53
2023/0192260 A1 * 6/2023 Dannenberg ..... B63H 20/00 114/144 R

FOREIGN PATENT DOCUMENTS

JP 57-41292 A 3/1982
JP 57-209491 A 12/1982
(Continued)

*Primary Examiner* — Steven M Marsh
(74) *Attorney, Agent, or Firm* — Keating & Bennett, LLP

(57) ABSTRACT

A suspension structure for an outboard motor and an outboard motor includes a clamp bracket, a main body support having a lowest position in a tilt-down state among portions supporting an outboard motor main body except for the clamp bracket, and a coupling fixed to the main body support and supported turnably about a tilt shaft at a first position and a second position in an axial direction of the tilt shaft. The main body support is between the first position and the second position and parallel to the axial direction of the tilt shaft. In the tilt-down state, the main body support is lower than the first position and the second position, and an imaginary triangle is defined by the first position, the second position, and the main body support as vertices when viewed from a rear.

8 Claims, 7 Drawing Sheets

(56) References Cited

FOREIGN PATENT DOCUMENTS

| | | | |
|---|---|---|---|
| JP | 07-10083 | A | 1/1995 |
| JP | 2000-289691 | A | 10/2000 |
| JP | 2001-001988 | A | 1/2001 |
| JP | 2001-088787 | A | 4/2001 |
| JP | 2022-098623 | A | 7/2002 |
| JP | 2005-319877 | A | 11/2005 |
| JP | 2005-329829 | A | 12/2005 |
| JP | 4093520 | B2 | 6/2008 |
| JP | 2008-162331 | A | 7/2008 |
| JP | 2019107995 | A | 7/2019 |
| JP | 2022-098622 | A | 7/2022 |

* cited by examiner

SUSPENSION STRUCTURE FOR OUTBOARD MOTOR AND OUTBOARD MOTOR

CROSS REFERENCE TO RELATED APPLICATIONS

This application claims the benefit of Japanese Patent Application No. 2021-184080, filed Nov. 11, 2021, which is hereby incorporated by reference herein in its entirety.

BACKGROUND OF THE INVENTION

1. Field of the Invention

The present invention relates to a suspension structure for an outboard motor and an outboard motor.

2. Description of the Related Art

As disclosed in Japanese Laid-open Patent Publication (Kokai) No. 2019-107995, a suspension structure for suspending an outboard motor main body to a hull is known. A suspension structure typically includes a clamp bracket to be fixed to a hull, a tilt shaft attached to the clamp bracket, and a swivel bracket turnably attached to the clamp bracket though the tilt shaft. An outboard motor main body is fixed to the swivel bracket. This arrangement allows the outboard motor main body to be turnable about the tilt shaft and an angle of inclination to the clamp bracket (to the hull) to be changeable.

A lateral load may be applied to the lower portion of the outboard motor main body during navigation. For example, a leftward or rightward water pressure may be applied to the propulsion device when the hull turns. Further, a lateral load may be applied when the hull leaves the surface of water and lands on water in a large swell.

For example, according to Japanese Laid-open Patent Publication (Kokai) No. 2001-88787 A, it is considered that if a lateral load is applied to the lower portion of the outboard motor, a large bending moment due to the lateral load acts on the swivel bracket through the mount. Simply increasing the member strength in order to increase the strength of the swivel bracket results in an increase in the overall weight of the suspension structure, and thus there is room for improvement.

SUMMARY OF THE INVENTION

Preferred embodiments of the present invention provide suspension structures for outboard motors each having an increased strength while significantly reducing or preventing an increase in the weight thereof.

According to a preferred embodiment of the present invention, a suspension structure for an outboard motor includes a clamp bracket to be attached to a hull, a main body support having a lowest position in a tilt-down state among portions supporting an outboard motor main body except for the clamp bracket, and a coupling fixed to the main body support and supported turnably about a tilt shaft at a first position and a second position in an axial direction of the tilt shaft, wherein the main body support is between the first position and the second position and parallel to the axial direction of the tilt shaft, and when the outboard motor main body is in the tilt-down state, the main body support is lower than the first position and the second position, and an imaginary triangle is defined by the first position, the second position, and the main body support as vertices when viewed from a rear.

According to this configuration, for example, when the main body support receives a thrust force parallel to the axial direction of the tilt shaft, a compressive force acts on the coupling between the main body support and one of the first position and the second position, and a tensile force acts on the coupling between the main body support and the other of the first position and the second position. Thus, it is less necessary to increase the member strength of the coupling in order to cope with a bending stress. Therefore, the strength of the suspension mechanism is increased while significantly reducing or preventing an increase in the weight thereof.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
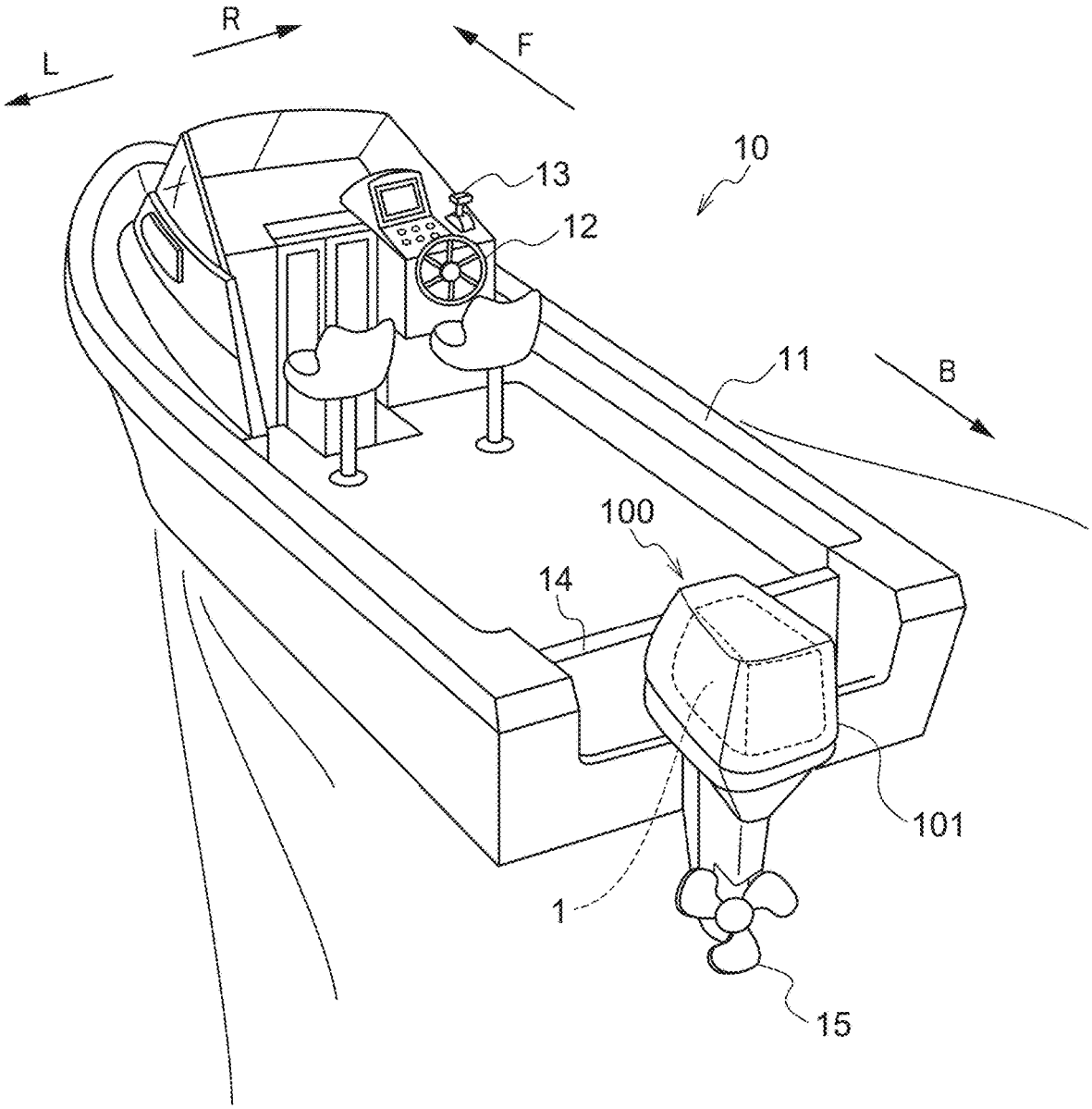
FIG. 1 is a perspective view of a marine vessel to which a suspension structure for an outboard motor is applied.

FIG. 1 is a perspective view of a marine vessel 10 to which a suspension structure for an outboard motor according to a preferred embodiment of the present invention is applied. The marine vessel 10 includes a hull 11, a steering wheel 12, a remote controller 13, and an outboard motor 100. The outboard motor 100 includes an outboard motor main body 101 and a suspension mechanism 200 (described below with reference to FIG. 2 and other figures) supporting the outboard motor main body 101. The outboard motor main body 101 is attached to a transom 14 of the back portion of the hull 11 through the suspension mechanism 200.

In the following description, unless otherwise specified, front, back, left, and right are referred to in a state in which a steering axis 41 (FIGS. 4 and 6) extends vertically and the outboard motor 100 does not incline left or right with respect to the hull 11 as a reference state. In the reference state, the left-and-right direction indicates a left-and-right direction when the marine vessel 10 is viewed from the rear. Reference signs F, B, L, and R in the drawings represent front, back, left, and right, respectively. For convenience, it is assumed that the state in which the steering axis 41 extends vertically belongs to a tilt-down state of the outboard motor 100.

The steering wheel 12 is provided to steer the hull 11. In response to operation of the steering wheel 12 by a vessel operator of the marine vessel 10, the outboard motor main body 101 turns left or right with respect to the hull 11. Operation of the remote controller 13 by the vessel operator enables the outboard motor 100 to switch a state thereof (shift-change) to moving forward, moving backward, or neutral. The outboard motor main body 101 includes an engine 1 and a propulsion device including a propeller 15. The engine 1 is provided with a throttle valve (not shown). The vessel operator is able to adjust the opening of the throttle valve by operating the remote controller 13. The output of the outboard motor 100 is able to be adjusted by adjusting the opening of the throttle valve.

Figure 2:
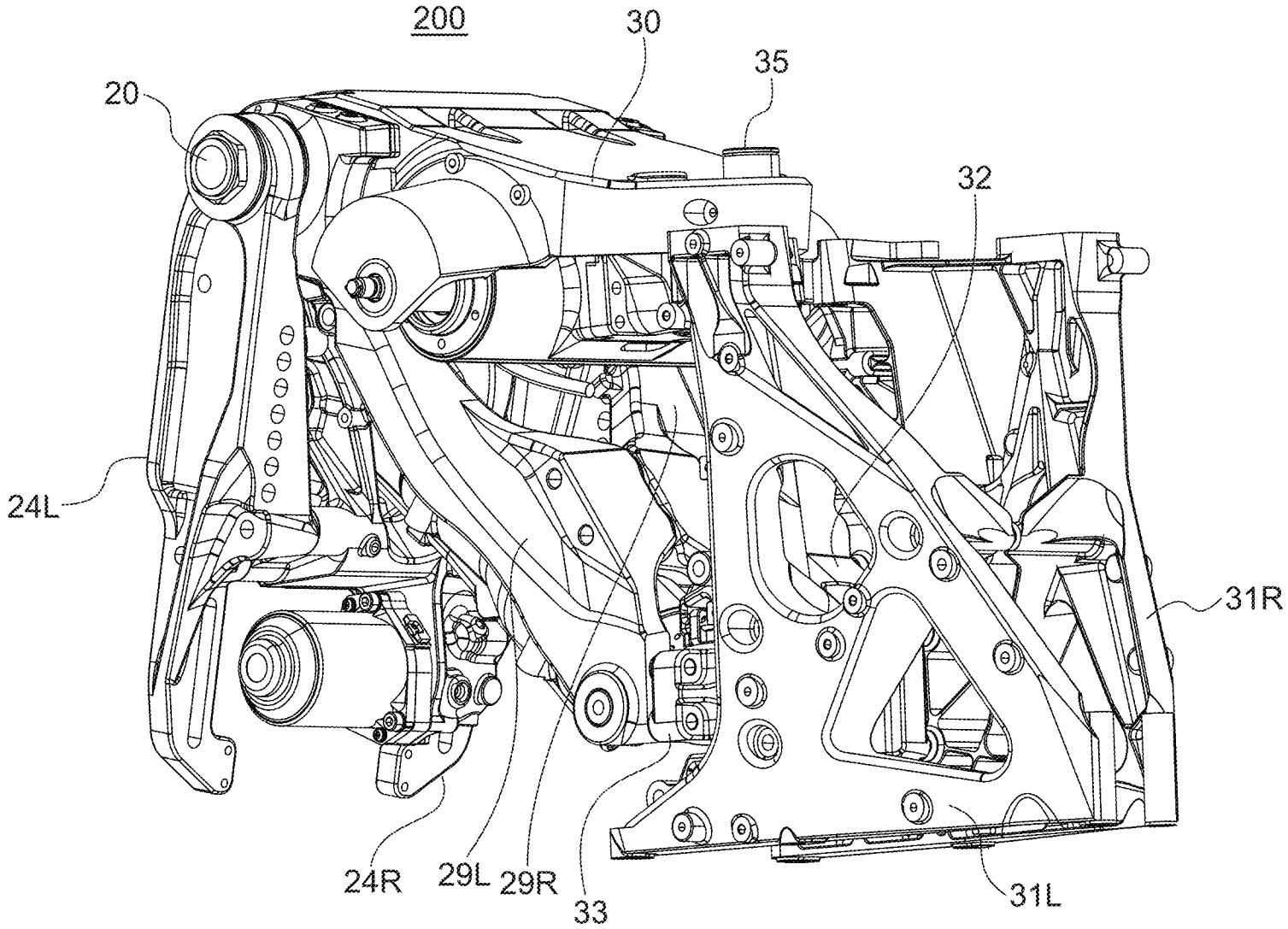
FIG. 2 is a perspective view of the suspension mechanism (in a tilt-down state).
Figure 3:
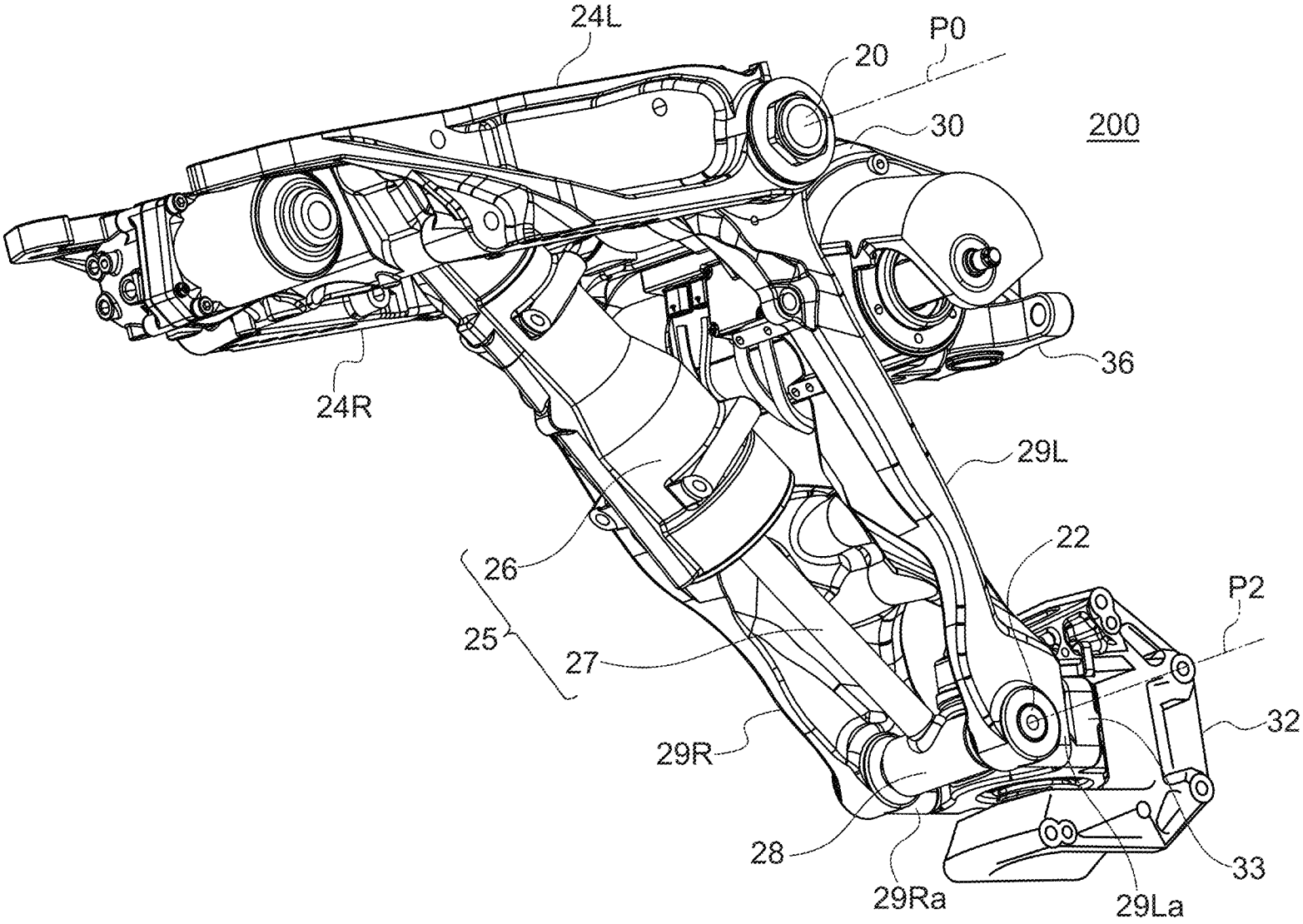
FIG. 3 is a perspective view of the suspension mechanism (in a tilt-up state).
Figure 4:
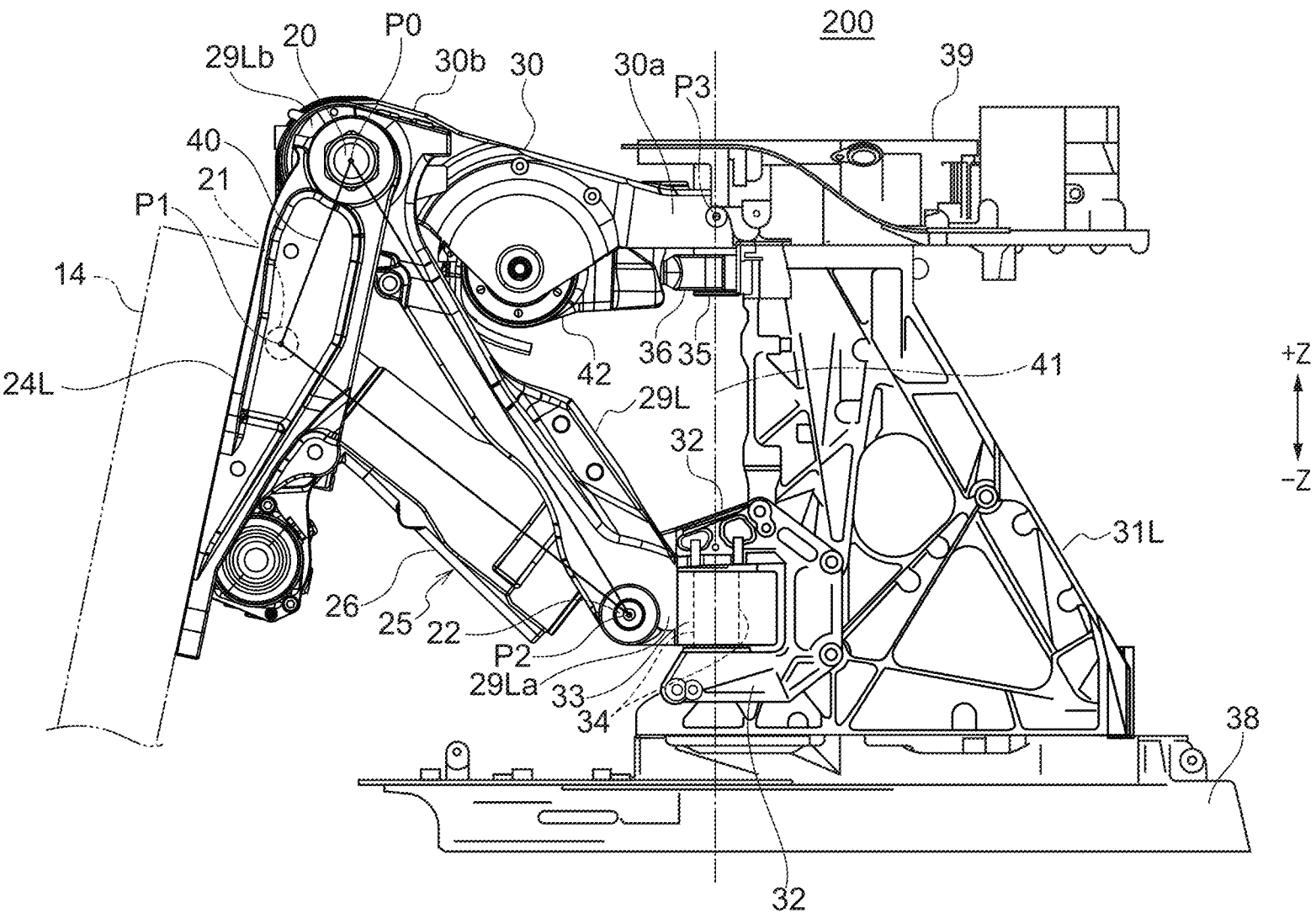
FIG. 4 is a side view of the suspension mechanism from the left thereof (in a tilt-down state).
Figure 5:
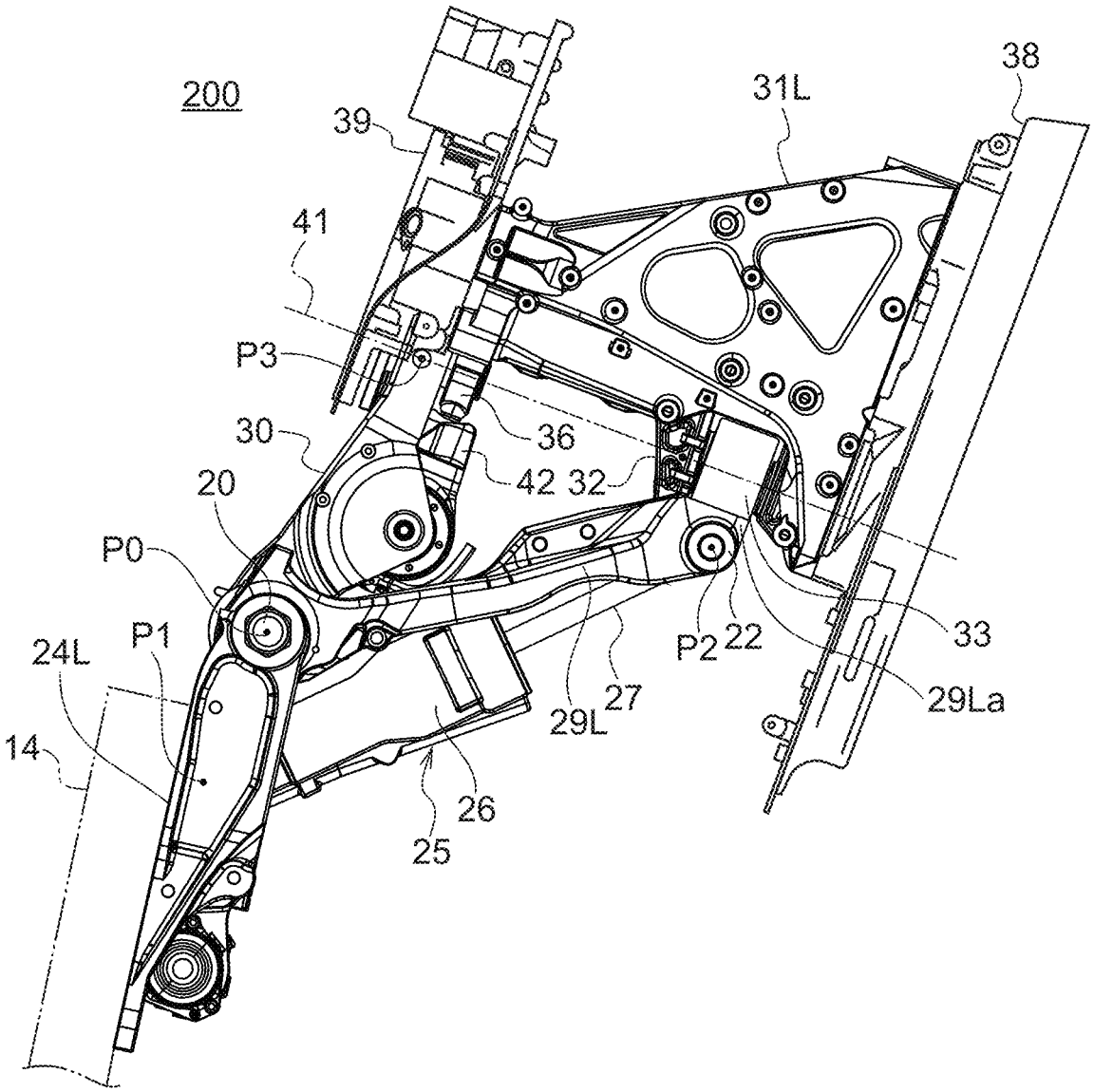
FIG. 5 is a side view of the suspension mechanism from the left thereof (in a tilt-up state).

FIGS. 2 and 3 are perspective views of the suspension mechanism 200. FIGS. 4 and 5 are side views of the suspension mechanism 200 from the left thereof. FIGS. 2 and 4 show the outboard motor 100 in the tilt-down state, and FIGS. 3 and 5 show the outboard motor 100 in a tilt-up state. Note that FIGS. 4 and 5 also show a lower case 38 and an exhaust guide 39 included in the outboard motor main body 101. In FIG. 3, a pair of frames 31L and 31R is not shown. In FIG. 4, the left frame 31L is not shown.

As shown in FIG. 4, hereinafter, a direction parallel to the steering axis 41 is defined as a Z direction. In particular, with the outboard motor 100 in the tilt-down state, the +Z direction is upward and the −Z direction is downward.

As shown in FIGS. 2 to 5, the suspension mechanism 200 includes, as main elements, a swivel bracket 30, the pair of frames 31L and 31R, a pair of clamp brackets 24L and 24R, a pair of side swivel brackets 29L and 29R, and a power tilt and trim (PTT) cylinder 25. Note that the frames 31L and 31R may be considered as elements of the outboard motor main body 101. The PTT cylinder 25 includes a cylinder main body 26 and a rod 27.

As shown in FIGS. 2 and 4, a mount holder 32 is fixed to the respective front lower portions of the frames 31L and 31R with the outboard motor main body 101 in the tilt-down state. The mount holder 32 holds the lower mount 33, and is preferably U-shaped or substantially U-shaped in a side view. The mount holder 32 pinches the lower mount 33 in the direction of the steering axis 41 (Z direction). The lower mount 33 functions as a main body support supporting the outboard motor main body 101, and as a single main load receiver mainly receiving the weight of the outboard motor main body 101. Among the elements supporting the outboard motor main body 101, the lower mount 33 has the lowest position, except for the clamp brackets 24L and 24R, when the outboard motor main body 101 is in the tilt-down state. The lower mount 33 holds a lower pivot 34 (FIG. 4).

With the outboard motor main body 101 in the tilt-down state, an upper pivot 35 (held portion) is higher in position (in the +Z direction) than the lower mount 33. The lower pivot 34 and the upper pivot 35 function as a steering axis. That is, a drive shaft (not shown) passes through the hole in the lower pivot 34 and the hole in the upper pivot 35. The steering axis 41 is the center line of the pivots 34 and 35, and coincides with the axis of the drive shaft. Details of the upper pivot 35 will be described below with reference to FIG. 7.

Figure 6:
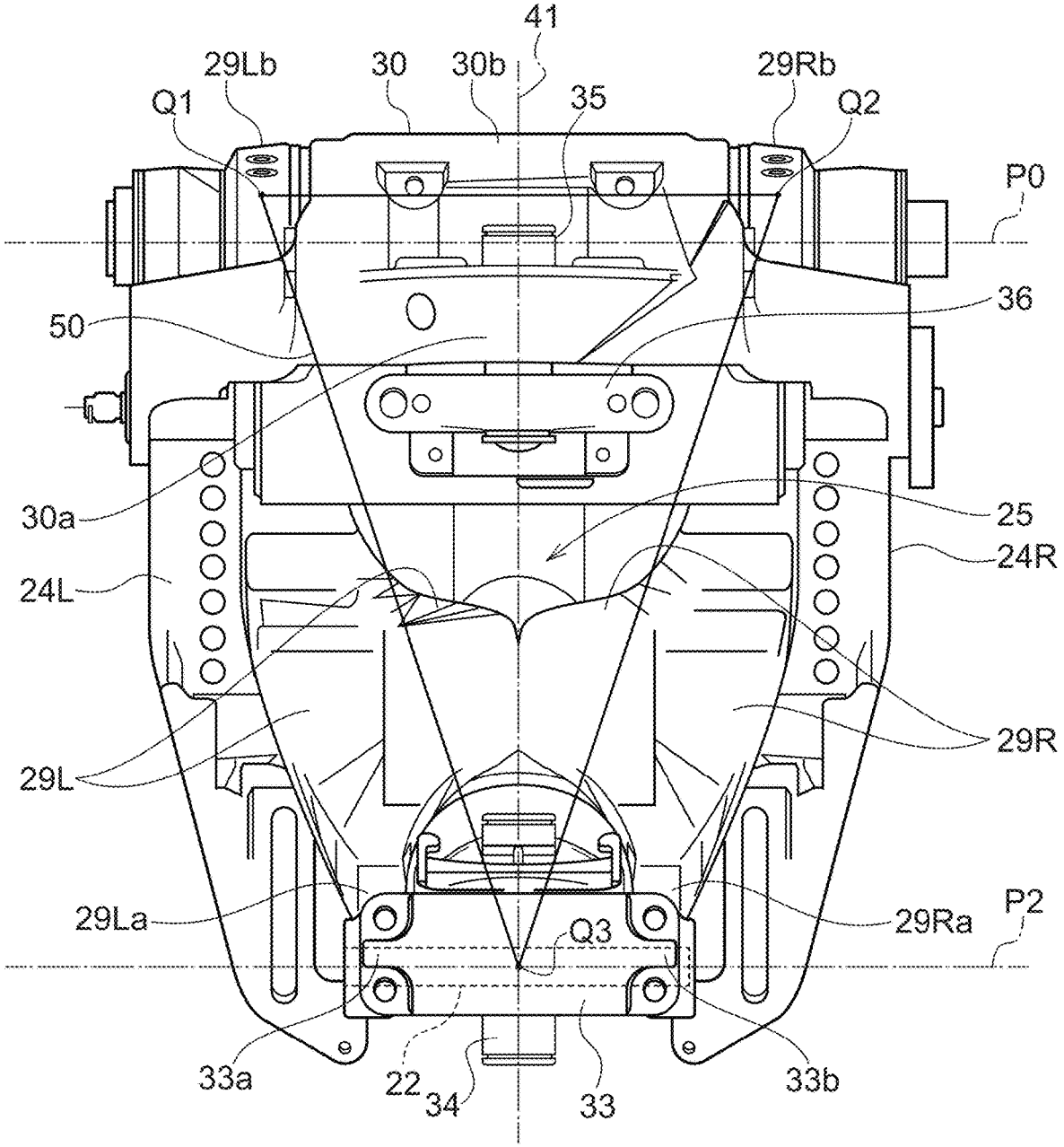
FIG. 6 is a rear view of a main portion of the suspension mechanism (in a tilt-down state).

FIG. 6 is a rear view of a main portion of the suspension mechanism 200. FIG. 6 shows the outboard motor 100 in the tilt-down state. In FIG. 6, the frames 31L and 31R, the lower case 38, and the exhaust guide 39 are not shown.

As shown in, for example, FIGS. 4 and 5, the pair of clamp brackets 24L and 24R are fixed to the back surface of the transom 14 with fasteners (not shown). A tilt shaft 20 is supported by the clamp bracket 24L and the clamp bracket 24R. The tilt shaft 20 extends in the left-and-right direction and is oriented horizontally or substantially horizontally. The tilt axis P0 is the central axis of the tilt shaft 20. The side swivel brackets 29L and 29R (coupling) and the swivel bracket 30 (a second coupling) are supported turnably about the tilt axis P0 by the tilt shaft 20.

As shown in FIG. 6, a front end portion 29Lb, which is one end of the side swivel bracket 29L, is supported by the tilt shaft 20, and a front end portion 29Rb, which is one end of the side swivel bracket 29R, is supported by the tilt shaft 20. Thus, the side swivel brackets 29L and 29R are turnable about the tilt axis P0.

A front end portion 30*b*, which is one end of the swivel bracket 30, is supported by the tilt shaft 20 in the region between the front end portion 29Lb of the side swivel bracket 29L and the front end portion 29Rb of the side swivel bracket 29R. Thus, the swivel bracket 30 is turnable about the tilt axis P0 in the up-and-down direction relatively to the clamp brackets 24L and 24R.

In the direction of the tilt axis P0 (left-and-right direction), the front end portion 29Lb is located at the left end portion of the tilt shaft 20, and the front end portion 29Rb is located at the right end portion of the tilt shaft 20. Thus, the position (first position) of the front end portion 29Lb and the position (second position) of the front end portion 29Rb are spaced apart from each other in the direction of the tilt axis P0.

As shown in, for example, FIGS. 4 and 6, a back end portion 29La, which is the other end of the side swivel bracket 29L, and a back end portion 29Ra, which is the other end of the side swivel bracket 29R, are both fixed to the lower mount 33 with a plurality of bolts, for example. In particular, in the left-and-right direction, the back end portion 29La is fixed to a support position 33*a*, which is a left end portion of the lower mount 33, and the back end portion 29Ra is fixed to a support position 33*b*, which is a right end portion of the lower mount 33 (FIG. 6). The back end portion 29La and the back end portion 29Ra are pivotally supported by a second pivot shaft 22. The second pivot center P2 is the central axis of the second pivot shaft 22. The second pivot shaft 22 is located adjacent or near the lower mount 33.

The PTT cylinder 25 changes a trim angle or a tilt angle of the outboard motor main body 101. The PTT cylinder 25 extends from the back end portions 29La and 29Ra to the clamp brackets 24L and 24R.

As shown in FIG. 3, the rod 27 of PTT cylinder 25 includes a coupler 28. The coupler 28 is pivotally supported by the second pivot shaft 22 between the back end portion 29La and the back end portion 29Ra in the left-and-right direction. This arrangement allows the side swivel brackets 29L and 29R and the PTT cylinder 25 to be relatively turnable with respect to each other about the second pivot center P2. The cylinder main body 26 of the PTT cylinder 25 is coupled to the clamp brackets 24L and 24R through a housing of the cylinder main body 26 and is turnable about the first pivot center P1 (FIGS. 4 and 5) of a first pivot shaft 21. Thus, the clamp brackets 24L and 24R and the cylinder main body 26 are relatively turnable with respect to each other about the first pivot center P1. The first pivot center P1 is lower in position than the tilt shaft 20.

Figure 7:
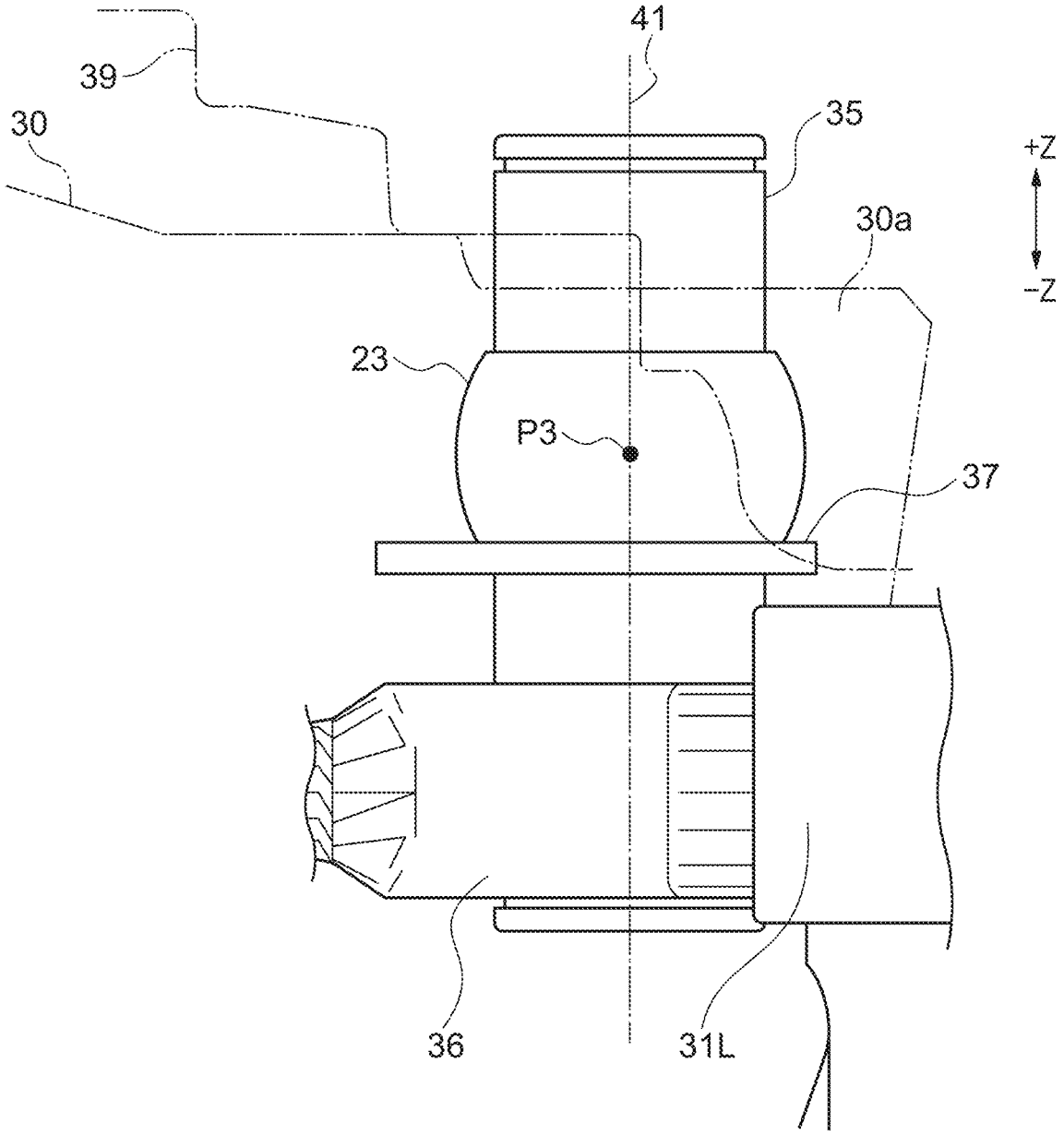
FIG. 7 is an enlarged side view of the periphery of an upper pivot.

FIG. 7 is an enlarged side view of the periphery of the upper pivot 35. A back end portion 30*a* (see also FIGS. 4 and 6), which is the other end of the swivel bracket 30, supports the upper pivot 35 turnably about the third pivot center P3 (third pivot shaft) at least in the up-and-down direction. The upper pivot 35 is regulated in position in the Z direction by the exhaust guide 39 and a plate 37. The upper pivot 35 includes a spherical portion 23. The back end portion 30*a* of the swivel bracket 30 is slidably engaged with the spherical portion 23 through a bush (not shown). This arrangement allows the back end portion 30*a* of the swivel bracket 30 and the spherical portion 23 to be relatively turnable with respect to each other about the steering axis 41 and to be relatively turnable with respect to each other about the third pivot center P3.

A steering bracket 36 is engaged with a position in the −Z direction with respect to the spherical portion 23 in the upper pivot 35, and a driver 42 is connected to the steering bracket 36 (see also FIGS. 4 and 5). The frames 31L and 31R are fixed to the steering bracket 36. The driver 42 causes the steering bracket 36 to turn about the steering axis 41. As a result, the frames 31L and 31R turn about the steering axis 41. The turning of the frames 31L and 31R allows the orientation of the outboard motor main body 101 in the left-and-right direction to be changed.

The side swivel brackets 29L and 29R are linear or substantially linear in shape in a side view (FIGS. 4 and 5). Further, the side swivel bracket 29L includes a portion that extends from the front end portion 29Lb to the lower mount 33 and is linear or substantially linear in shape in a rear view, and the side swivel bracket 29R includes a portion that extends from the front end portion 29Rb to the lower mount 33 and is linear or substantially linear in shape in a rear view (FIG. 6).

As shown in FIG. 4, with the outboard motor main body 101 in the tilt-down state, the third pivot center P3 is lower in position than the tilt shaft 20. That is, in the tilt-down state, the swivel bracket 30 inclines downward toward the rearward direction. Further, with the outboard motor main body 101 in the tilt-down state, the second pivot shaft 22 is lower in position than the first pivot shaft 21. That is, in the tilt-down state, the PTT cylinder 25 inclines downward toward the rearward direction.

As shown in FIG. 6, the lower mount 33 is located between the front end portion 29Lb and the front end portion 29Rb in the direction parallel to the tilt axis P0 (left-and-right direction). Further, in the tilt-down state, the lower mount 33 is lower in position than the front end portion 29Lb and the front end portion 29Rb. In the tilt-down state, an imaginary triangle 50 is defined by the front end portion 29Lb, the front end portion 29Rb, and the lower mount 33 as vertices, when viewed from the rear. The respective center positions of the front end portions 29Lb and 29Rb and the lower mount 33 as viewed from the rear define vertices Q1, Q2, and Q3, respectively. The vertices Q1, Q2, and Q3 define the triangle 50.

Meanwhile, as shown in FIG. 4, an imaginary triangle 40 defined by the tilt axis P0 of the tilt shaft 20, the first pivot center P1 of the first pivot shaft 21, and the second pivot center P2 of the second pivot shaft 22 as vertices, in a side view.

Next, the operation of tilting up/down the outboard motor main body 101 by the PTT cylinder 25 will be described. The rod 27 extends and contracts with respect to the cylinder main body 26 due to a drive source (not shown). When the rod 27 extends, the coupler 28 (FIG. 3) pushes the second pivot shaft 22. Then, the side swivel brackets 29L and 29R receive a biasing force through the second pivot shaft 22, and turn upward (counterclockwise direction in FIG. 4), which is in the tilt-up direction about the tilt axis P0. Because the distance between the second pivot center P2 and the third pivot center P3 is constant, the swivel bracket 30 also turns in the tilt-up direction about the tilt axis P0 in conjunction with the side swivel brackets 29L and 29R.

Conversely, when the rod 27 contracts from the state in which the rod 27 extends due to the tilting up, the side swivel brackets 29L and 29R and the swivel bracket 30 turn in the tilt down direction about the tilt axis P0. In the tilting up/down process, the shape of a triangle defined by the tilt axis P0, the second pivot center P2, and the third pivot center P3 as vertices in a side view, is maintained.

A lateral load may be applied to the lower portion of the outboard motor main body 101 during navigation. For example, a leftward or rightward water pressure may be applied when the hull 11 turns. Further, a lateral load may be applied when the hull 11 leaves the surface of water and lands on water in a large swell. Furthermore, a forward thrust force due to thrust is applied to the suspension mechanism 200. In the prior art, a large bending stress may act on the component members of the suspension mechanism due to a thrust force, the lateral load, or the own weight of the outboard motor main body. However, when the strength of the component members of the suspension mechanism is simply increased, its overall weight increases. Therefore, the present preferred embodiment reduces a bending stress acting on the component members of the suspension mechanism 200.

As described above, the side swivel brackets 29L and 29R are linear or substantially linear in shape. As shown in FIG. 6, the lower mount 33 is located between the front end portion 29Lb and the front end portion 29Rb in the direction parallel to the tilt axis P0. In the tilt-down state, the lower mount 33 is lower in position than the front end portion 29Lb and the front end portion 29Rb, and the vertices Q1, Q2, and Q3 define the triangle 50 when viewed from the rear.

Thus, if the lower mount 33 receives a thrust force from the right, a force (compressive force) that is able to compress a member acts on the side swivel bracket 29L between the front end portion 29Lb and the lower mount 33, and a force (tensile force) that is able to extend a member acts on the side swivel bracket 29R between the front end portion 29Rb and the lower mount 33. An action due to reception of a thrust force from the left is opposite to the above action. That is, with respect to a thrust force from the left-and-right direction, a compressive force acts on one of the side swivel brackets 29L and 29R, and a tensile force acts on the other of the side swivel brackets 29L and 29R. A bending stress hardly acts on the side swivel brackets 29L and 29R. Thus, an increase in the member strength of the side swivel brackets 29L and 29R to cope with the bending stress is significantly reduced. Therefore, the member strength of the suspension mechanism 200 is increased while significantly reducing or preventing an increase in the weight thereof.

Further, as shown in FIG. 4, the second pivot shaft 22 coupling the back end portion of the PTT cylinder 25 and the side swivel brackets 29L and 29R is located adjacent or near the lower mount 33. In a side view, the imaginary triangle 40 defined by the tilt axis P0, the first pivot center P1, and the second pivot center P2 as the vertices. Therefore, at least in the tilt-down state, due to the weight of the outboard motor main body 101 or a forward thrust force, a tensile force acts on the side swivel brackets 29L and 29R between the tilt shaft 20 and the second pivot shaft 22, and a compressive force acts on the PTT cylinder 25 between the first pivot shaft 21 and the second pivot shaft 22. As a result, a bending stress applied to the side swivel brackets 29L and 29R due to the weight of the outboard motor main body 101 or the forward thrust force is reduced. Thus, an increase in the member strength of the side swivel brackets 29L and 29R to cope with the bending stress is significantly reduced. Therefore, the strength of the suspension mechanism 200 is increased while significantly reducing or preventing an increase in the weight thereof.

Moreover, in the tilt-down state, the upper pivot 35 is higher in position than the lower mount 33. Further, the front end portion 30*b* of the swivel bracket 30 is supported turnably by the tilt shaft 20, and the back end portion 30*a* supports the upper pivot 35 turnably about the third pivot center P3. With this arrangement, the lower mount 33 as the main load receiver bears most of the weight of the outboard motor main body 101 or most of a forward thrust force.

In a state where the weight of the outboard motor main body 101 or a forward thrust force act, a force due to a rotational moment in the clockwise direction in FIG. 4 about the second pivot center P2 acts on the upper pivot 35, whereas a load in the vertical direction or a forward load hardly acts. Thus, the lower mount 33 bears most of the weight of the outboard motor main body 101 or most of the forward thrust force. As a result, the effect of reducing a bending stress acting on the side swivel brackets 29L and 29R as described above is enhanced. Moreover, a tensile force is mainly generated in the swivel bracket 30 against the rotational moment about the second pivot center P2. Therefore, because application of a bending stress to the swivel bracket 30 is significantly reduced, the weight of the swivel bracket 30 is reduced and the strength of the swivel bracket 30 is improved.

According to a preferred embodiment of the present invention, among portions supporting the outboard motor main body 101, the lower mount 33 is at the lowest in position, except for the clamp brackets 24L and 24R, when the outboard motor main body 101 is in the tilt-down state. The side swivel brackets 29L and 29R are supported turnably by the tilt shaft 20 at the front end portion 29Lb (first position) and the front end portion 29Rb (second position), and are fixed to the lower mount 33 at the back end portion 29La and the back end portion 29Ra. The lower mount 33 is located between the front end portion 29Lb and the front end portion 29Rb in the direction parallel to the tilt axis P0. In the tilt-down state, the lower mount 33 is lower in position than the front end portion 29Lb and the front end portion 29Rb. The imaginary triangle 50 defined by the front end portion 29Lb, the front end portion 29Rb, and the lower mount 33 as the vertices, when viewed from the rear (FIG. 6). Therefore, because a bending stress applied to the side swivel brackets 29L and 29R due to a lateral load is reduced, the strength of the suspension mechanism 200 is increased while significantly reducing or preventing an increase in the weight thereof.

Further, the side swivel brackets 29L and 29R are linear or substantially linear in shape, and the front end portion 29Lb and the front end portion 29Rb are spaced apart in the direction of the tilt axis P0. With this arrangement, a bending stress is less likely to act on the side swivel brackets 29L and 29R. Furthermore, the lower mount 33 bears most of the weight of the outboard motor main body 101 or most of a forward thrust force. As a result, the effect of reducing a bending stress from acting on the side swivel brackets 29L and 29R is enhanced thus resulting in contributing to an increase in the strength of the side swivel brackets 29L and 29R and eventually the strength of the suspension mechanism 200.

Further, according to a preferred embodiment of the present invention, at a position lower than the position of the tilt shaft 20, the housing (one end) of the cylinder main body 26 of the PTT cylinder 25 is supported turnably about the first pivot shaft 21 (first pivot center P1) in the up-and-down direction with respect to the clamp brackets 24L and 24R. Furthermore, the coupler 28 (the other end) of the rod 27 of the PTT cylinder 25 supports the side swivel brackets 29L and 29R turnably about the second pivot shaft 22 (second pivot center P2) in the up-and-down direction. Still furthermore, the second pivot shaft 22 is located adjacent or near the lower mount 33. With such a location, the imaginary triangle 40 is defined by the tilt axis P0, the first pivot center P1, and the second pivot center P2 as the vertices, in a side view (FIG. 4). Therefore, a bending stress applied to the side swivel brackets 29L and 29R due to the weight of the outboard motor main body 101 or a forward thrust force is reduced, and thus the strength of the suspension mechanism 200 is increased while significantly reducing or preventing an increase in the weight thereof.

Note that from the viewpoint of obtaining the above effects, the distance between the lower mount 33 and the second pivot shaft 22 in a side view is preferably shorter than that between the lower mount 33 and the tilt shaft 20 in the side view. Alternatively, from the viewpoint of obtaining these effects, the second pivot shaft 22 may be provided at the lower mount 33. That is, in the side view, the second pivot shaft 22 (or the second pivot center P2) may be superimposed on the lower mount 33.

Further, because the lower mount 33 bears most of the weight of the outboard motor main body 101 or most of a forward thrust force, the effect of reducing a bending stress from acting on the side swivel brackets 29L and 29R is enhanced, thus resulting in contributing to an increase in the strength of the side swivel brackets 29L and 29R and eventually the strength of the suspension mechanism 200.

Furthermore, in the tilt-down state, the third pivot center P3 is lower in position than the tilt shaft 20, and the swivel bracket 30 inclines downward toward the rearward direction (FIG. 4). With this arrangement, in the tilt-down state, generation of an upward tensile stress in the clamp brackets 24L and 24R near the tilt shaft 20 is prevented. Therefore, the fixed state of the clamp brackets 24L and 24R to the transom 14 is firm.

Moreover, in the tilt-down state, the second pivot shaft 22 is lower in position than the first pivot shaft 21, and the PTT cylinder 25 inclines downward toward the rearward direction (FIG. 4). With this arrangement, in the tilt-down state, an upward stress acts on the clamp brackets 24L and 24R at the position of the first pivot shaft 21. Therefore, in combination with this action and the fact that the swivel bracket 30 inclines downward toward the rearward direction, the distribution of stress applied to the clamp brackets 24L and 24R in the tilt-down state is optimized. As a result, the strength of the clamp brackets 24L and 24R is increased while significantly reducing or preventing an increase in the weight thereof.

Further, the mount holder 32 is preferably U-shaped or substantially U-shaped in a side view, and pinches the lower mount 33 in the direction of the steering axis 41 (FIG. 4). With this arrangement, even if the mount holder 32 turns about the steering axis 41 at the time of steering, the mount holder 32 is able to firmly hold the lower mount 33 while avoiding interference with the lower mount 33.

The shapes of the side swivel brackets 29L and 29R are not limited to the exemplified shapes, and thus may be, for example, shapes closer to a linear shape.

In a preferred embodiment of the present invention, the side swivel bracket is provided separately as the two components of the side swivel bracket 29L as a first member and the side swivel bracket 29R as a second member. These components, however, may be unitary as a single side swivel bracket. In such a case, the single side swivel bracket may be V-shaped or substantially V-shaped when viewed from the rear.

The marine vessel to which the suspension mechanism 200 of preferred embodiments of the present invention is applied is preferably any marine vessel to which an outboard motor is attachable, and thus the type is not limited.

The present invention has been described in detail based on the preferred embodiments described above. The present invention, however, is not limited to the specific preferred embodiments described above, and thus various changes can be made without departing from the gist of the present invention, and these changes are also included in the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A suspension structure for an outboard motor, the suspension structure comprising:

a clamp bracket to be attached to a hull;

a main body support having a lowest position in a tilt-down state among portions supporting an outboard motor main body except for the clamp bracket; and a coupling fixed to the main body support and supported turnably about a tilt shaft at a first position and a second position in an axial direction of the tilt shaft; wherein the main body support is between the first position and the second position and parallel to the axial direction of the tilt shaft, and when the outboard motor main body is in the tilt-down state, the main body support is lower than the first position and the second position, and an imaginary triangle is defined by the first position, the second position, and the main body support as vertices when viewed from a rear; and when the main body support receives a thrust force parallel to the axial direction of the tilt shaft, a compressive force acts on the coupling between the main body support and one of the first position and the second position, and a tensile force acts on the coupling between the main body support and the other of the first position and the second position.

2. The suspension structure according to claim 1, wherein the first position and the second position are spaced apart in the axial direction of the tilt shaft.

3. The suspension structure according to claim 1, wherein the main body support supports a weight of the outboard motor main body.

4. The suspension structure according to claim 3, further comprising:

a held portion higher in position than the main body support when the outboard motor main body is in the tilt-down state; and a second coupling including a first end supported turnably about the tilt shaft and a second end supporting the held portion turnably about a pivot shaft at least in an up-and-down direction.

5. The suspension structure according to claim 1, wherein a first portion of the coupling, which extends from the first position to the main body support, is linear or substantially linear in shape; and a second portion of the coupling, which extends from the second position to the main body support, is linear or substantially linear in shape.

6. The suspension structure according to claim 1, wherein the coupling is unitary.

7. The suspension structure according to claim 1, wherein the coupling includes a first member and a second member separate from the first member, the first member connects the first position and the main body support, and the second member connects the second position and the main body support.

8. An outboard motor including a suspension structure, the suspension structure comprising:

a clamp bracket to be attached to a hull;

a main body support having a lowest position in a tilt-down state among portions supporting an outboard motor main body except for the clamp bracket; and a coupling fixed to the main body support and supported turnably about a tilt shaft at a first position and a second position in an axial direction of the tilt shaft; wherein the main body support is between the first position and the second position and parallel to the axial direction of the tilt shaft, and when the outboard motor main body is in the tilt-down state, the main body support is lower than the first position and the second position, and an imaginary triangle is defined by the first position, the second position, and the main body support as vertices when viewed from a rear; and when the main body support receives a thrust force parallel to the axial direction of the tilt shaft, a compressive force acts on the coupling between the main body support and one of the first position and the second position, and a tensile force acts on the coupling between the main body support and the other of the first position and the second position.

* * * * *